US007758484B2

(12) United States Patent
Peterson

(10) Patent No.: US 7,758,484 B2
(45) Date of Patent: Jul. 20, 2010

(54) PACKAGING AND METHOD FOR MAKING THE SAME

(75) Inventor: Donald G. Peterson, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 985 days.

(21) Appl. No.: 11/323,725

(22) Filed: Dec. 30, 2005

(65) Prior Publication Data

US 2007/0160408 A1 Jul. 12, 2007

(51) Int. Cl.
*B31B 1/90* (2006.01)

(52) U.S. Cl. ..... 493/212; 493/210; 493/230; 493/238

(58) Field of Classification Search ..... 493/210, 493/212, 220–221, 223–224, 227, 230, 238–239, 493/264, 267
See application file for complete search history.

(56) References Cited

U.S. PATENT DOCUMENTS

| | | | | |
|---|---|---|---|---|
| 4,358,015 A | | 11/1982 | Hirsch | 206/439 |
| 4,417,658 A | | 11/1983 | Gardner et al. | 206/438 |
| 4,442,259 A | | 4/1984 | Isgur et al. | 524/839 |
| 4,510,621 A | | 4/1985 | Sak et al. | 383/89 |
| 4,598,826 A | | 7/1986 | Shinbach | 206/620 |
| 4,859,521 A | | 8/1989 | Pike et al. | |
| 4,881,649 A | | 11/1989 | Hsu et al. | 206/634 |
| 4,901,505 A | * | 2/1990 | Williams, Jr. | 53/412 |
| 4,944,409 A | | 7/1990 | Busche et al. | 206/632 |
| 5,145,929 A | | 9/1992 | Ou-Yang | 526/338 |
| 5,391,136 A | * | 2/1995 | Makowka | 493/210 |
| 5,443,154 A | * | 8/1995 | Hustad et al. | 206/213.1 |
| 5,510,124 A | | 4/1996 | Kopecky et al. | |
| 5,551,781 A | * | 9/1996 | Wilkes et al. | 383/205 |
| 5,590,777 A | | 1/1997 | Weiss et al. | 206/439 |
| 5,616,400 A | | 4/1997 | Zhang | 428/195 |
| 5,622,028 A | | 4/1997 | Harp | |
| 5,630,308 A | | 5/1997 | Guckenberger | 53/412 |
| 5,935,686 A | | 8/1999 | Daelmans et al. | |
| 5,947,288 A | * | 9/1999 | Dykstra et al. | 206/439 |
| 6,098,800 A | * | 8/2000 | Bennish et al. | 206/439 |
| 6,099,682 A | | 8/2000 | Krampe et al. | 156/289 |

* cited by examiner

*Primary Examiner*—Christopher Harmon
(74) *Attorney, Agent, or Firm*—Trisha D. Adamson

(57) ABSTRACT

A method of manufacturing a package is provided, comprising a first and second layer attached by a sealing process to create a peelable seal. The package also includes perforation cuts at regular intervals. A traverse cut is provided through both the first and second layer that traverses the perforation cut in the first layer at least once. The traverse cut and perforation cut define a bonded section to form a tab.

11 Claims, 3 Drawing Sheets

PACKAGING AND METHOD FOR MAKING THE SAME

BACKGROUND OF THE INVENTION

Films or sheets of polymeric barrier materials are formed into a finished package by various techniques. Techniques include forming cold, heat or adhesive seals about the periphery of the shape to be formed into a package. Packages manufactured by these techniques are described in U.S. Pat. Nos. 6,099,682; 5,630,308; 5,590,777; 4,442,259; 5,616,400; 4,881,649; and 4,944,409.

The opening characteristics of packaging remain an important consideration. This is of particular concern in packaging pharmaceutical and medical supplies to maintain sterility within the package. It is also desirable that the package be easily opened with controlled predictable motion and force resulting in a decreased likelihood of spillage of the package contents.

Thus, packages that exhibit sufficient bond strength, are easier to manufacture, and yet are easily opened are still needed.

SUMMARY OF THE INVENTION

Methods for making a package and packages are provided by the present invention.

A method of manufacturing a package is provided, comprising providing a first layer with perforation cuts through the first layer; providing a second layer; attaching the first layer to the second layer by a sealing process to create a bonded area comprising a peelable seal; providing a traverse cut through both the first and second layer that traverses the perforation cut in the first layer at least once to form at least two bonded sections in the first layer; wherein at least one bonded section created by the sealing process forms a tab defined by the perforation cut and traverse cut; and wherein at least a portion of the first and second layer adjacent the perforation cut is unbonded.

In one embodiment, a package is provided, comprising a first layer with perforation cuts through the first layer; a second layer attached to the first layer in a bonded area by a bonded area; a traverse cut through both the first and second layer that traverses the perforation cut in the first layer at least once to form a tab; at least one bonded section in the bonded area is contained within the tab created by the perforation cut and traverse cut; wherein the first layer formed from the traverse cut and perforation cut is retained on the bonded section of the second layer; and wherein at least a portion of the area first layer and second layer adjacent the perforation cut is unbonded.

In another embodiment, a package is provided, comprising a first layer with perforation cuts through the first layer; a second layer attached to the first layer in a bonded area by a peelable seal; a traverse cut through both the first and second layer that traverses the perforation cut in the first layer to form at least two discrete bonded portions; wherein the at least two discrete bonded portions of the first layer are bonded to the second layer.

As used herein, "non-refastenable cold seal" means a seal formed between two substrates using an adhesive or combination of adhesives that can form a bond at room temperature (i.e., about 20° C. to about 30° C.).

As used herein, "substantially natural latex rubber-free" refers to a contact adhesive composition to which natural rubber is not intentionally added. Preferably, the contact adhesive composition contains about 1 part per million (ppm) or less, and more preferably about 1 part per billion (ppb) or less, of a natural latex rubber and displays characteristics of a contact adhesive, as defined below.

As used herein, "contact adhesive" (also known as a cold seal adhesive) is one that preferentially adheres to itself or a chemically similar material under pressure or force without the need for significantly elevated temperatures (e.g., without the need for temperatures above 50° C.). Unlike pressure sensitive adhesives, contact adhesives are typically nonadhering or only very slightly adhering to chemically dissimilar surfaces at temperatures of about 15° C. to about 50° C. Contact adhesives that can be hot melt coated, but that do not require the application of heat to form a seal, are included.

A contact adhesive is distinguished from a pressure sensitive adhesive (PSA). A PSA is typically tacky at room temperature, requires moderate pressure to achieve a bond (such as that exerted by fingertip pressure), but which adheres to a wide variety of dissimilar substrates. A pressure sensitive adhesive is conventionally understood to refer to an adhesive that displays permanent and aggressive tackiness to a wide variety of substrates after applying only light pressure.

DESCRIPTION OF THE PREFERRED EMBODIMENTS

Figure 1:
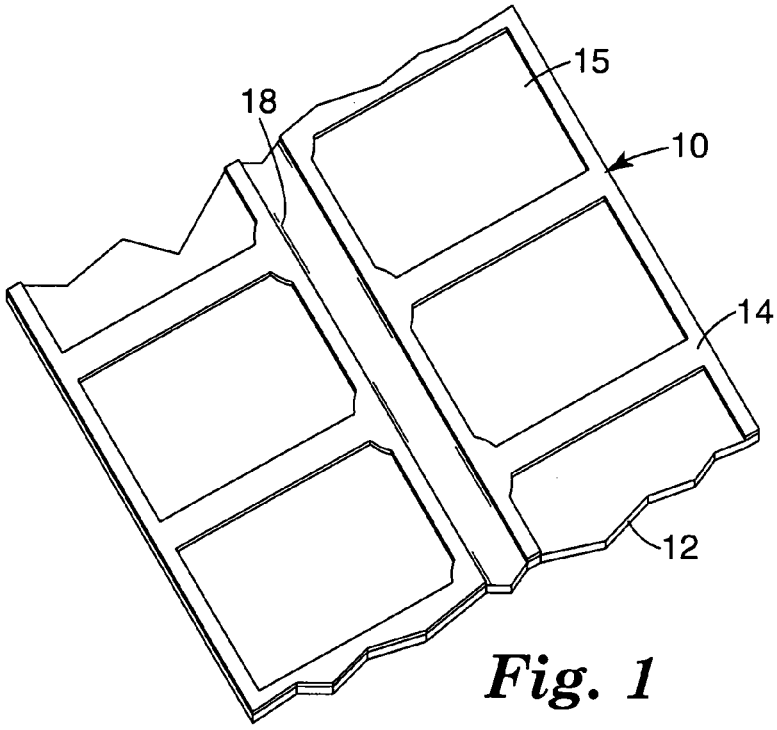
FIG. 1 is a perspective view of a package layer in one illustrative embodiment in accordance with the invention.

A method of manufacturing a package is provided, comprising a first and second layer attached by a sealing process to create a peelable seal. The package also includes perforation cuts at regular intervals that can be a precut on the first layer or second layer before the sealing process, or cut as a step in package construction the sealing process (including the sealing process). Suitable sealing processes to form the packages include cold seal processes, heat seal processes; and adhesive attachment processes (pressure sensitive adhesive, radiation cure adhesives etc.).

A traverse cut is provided through both the first and second layer that traverses the perforation cut in the first layer (or second layer) at least once. The traverse cut and perforation cut define a bonded section to form a tab containing portions of both the first and second layer. Unlike traditional manufacturing processes that require removal of waste portions, the bonded section retains the waste portion generated by the traverse and perforation cut on the final package. The method of the present invention can be used for packages produced in a down web or cross web orientation, and is particularly useful for nesting or multiple lane applications, such as the package web orientation shown in FIG. 2. The cut lines provided in the method of the present invention can be provided by various means known in the art, such as rotary die cut, platen die cut, laser scoring, etc.

In a preferred embodiment, the method of manufacturing the package includes a cold seal process to create the peelable seal. Cold seal packages have openings that are sealed under the application of pressure without the need for the application of elevated temperatures. Cold seal packaging can be used to package a variety of goods, including pharmaceuticals and medical supplies.

A non-refastenable cold seal can be formed, for example, between two sealing portions of the substrate(s) and two layers of contact adhesive, which may be the same or different. The bond formed at the interface of the two layers of contact adhesive is typically a substantially permanent bond (referred to herein as a cold seal bond or a cold seal adhesive bond). That is, upon opening the package of the present invention at the cold seal, the layers of adhesive are not separated from each other. The bond formed at the interface of a layer of the contact adhesive and one of the substrates is also typically a permanent bond, whereas the bond formed at the interface of a layer of the contact adhesive and the other substrate is a peelable and nonrefastenable bond, typically as a result of a layer of a release coating on the surface of the substrate. The peelability may result from release of the adhesive and the release coating from the substrate, or portions thereof, or from release of just the adhesive with the release coating remaining on the substrate. Other examples of a preferred cold seal process for use with the present invention are further described in U.S. Pat. No. 6,099,682, which is incorporated herein by reference in its entirety.

The package produced by the method of the present invention has a shape designed to minimize the area of film used per product, yet provide a significant tab to open the product typically with the use of gloves. This design uses half the amount of packaging films in the tab area. By having the tab in the center of the package, the package becomes more intuitive for the user to open.

In addition, by using a series of cuts and patterns around the sealed areas, the removal of a waste portion of one of the packaging webs to obtain an offset tab between the package layers of the final package is obviated. Typically in down web packages, and some crossweb opening packages, the offset tab is obtained through removal of a waste portion of one layer of material. Failure to remove the waste portion can introduce defects in the manufacturing process, including migration of the waste portion into the sealed areas.

Referring to FIG. 1, a first layer 10 of one embodiment of a package in accordance with the invention is shown. In one preferred embodiment, first layer 10 includes a first substrate 12 in the form of a sheet material. Coated thereon is a first contact adhesive 14 in a periphery pattern. Alternatively, contact adhesive 14 can be coated in any desired pattern on the first layer 10, including the entire surface of the substrate 12 such that the contact adhesive 14 is substantially contiguous with the substrate 12.

The first layer 10 of FIG. 1 further includes perforation cuts 18 spaced at regular intervals relative to the coated pattern of the contact adhesive 14. The perforation cuts 18 are preferably cut through first layer 10 after the first layer has been pattern coated with contact adhesive 14. Preferably, the distance between perforation cut 18 and the pattern of contact adhesive 14 is at least 1 mm.

Figure 2:
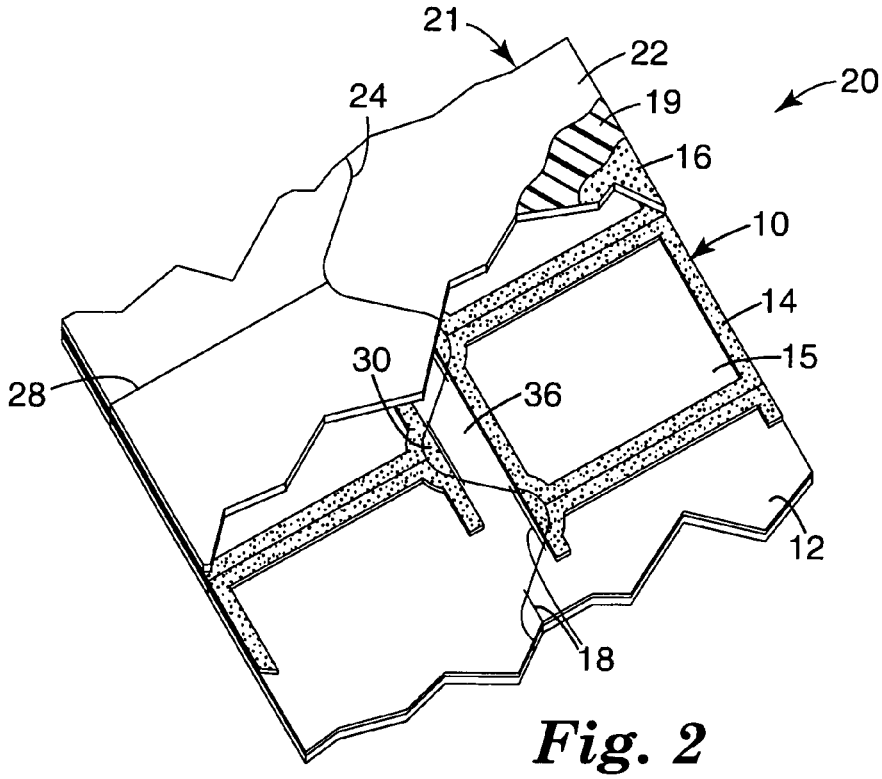
FIG. 2 is a perspective view of a package web in one illustrative embodiment in accordance with the invention.

In FIG. 2, a package web 20 includes a second layer 21 with a second substrate 22 in the form of a sheet material. Coated thereon is a second contact adhesive 16. The second contact adhesive 16 can also be coated in any desired pattern on the second layer 21, including the entire surface of the substrate 22 such that the contact adhesive 16 is substantially contiguous with the substrate 22. The layer of contact adhesive 16 is coated on a layer of a release coating 19 in a substantially contiguous manner on the substrate 22.

Figure 3:
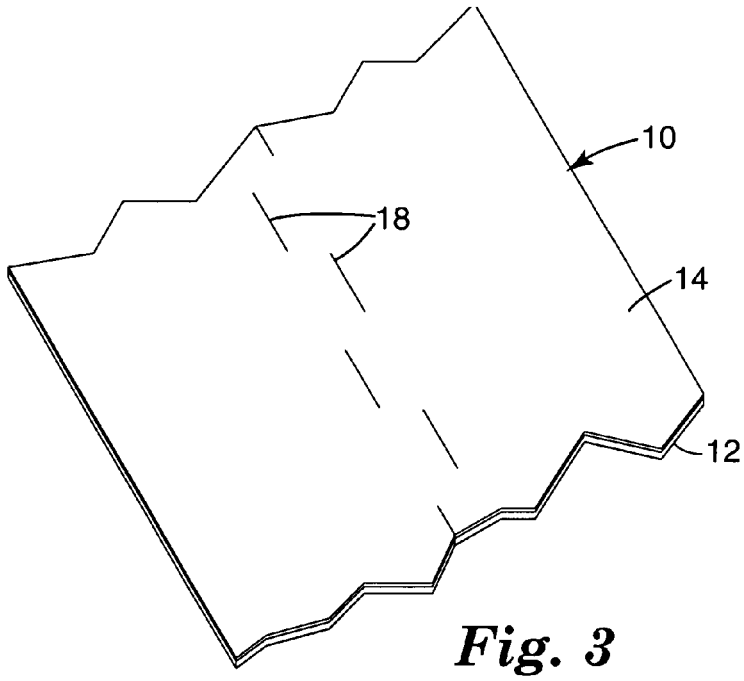
FIG. 3 is a perspective view of a package layer in another illustrative embodiment in accordance with the invention.

In an alternative embodiment shown in FIG. 3, first layer 10 is coated with contact adhesive 14 substantially contiguous with the substrate 12. Perforation cuts 18 are spaced at regular intervals on first layer 10 relative to the known dimensions of a pattern of coated adhesive and release coating provided on the second layer (not shown).

In certain embodiments of the method, first layer 10 and second layer 21 are on two separate substrates, as for example, when each comprises a first major surface of separate sheet materials. In other embodiments, however, first layer 10 and second layer 21 are on two different portions of the same substrate, as for example, a contiguous sheet material. When both layers are part of a contiguous sheet material, the first layer 10 and second layer 21 may each be on a different portion of a first major surface of the sheet material. Alternatively, the first layer 10 may be on a portion of a first major surface of the sheet material and the second layer 21 may be on a second major surface of the sheet material.

The first contact adhesive 14 and the second contact adhesive 16 can each be the same or a different contact adhesive. Preferably, the contact adhesive can include two layers of different contact adhesives, one coated on each of the first layer and second layer at a coating weight of about 4.0 $g/m^2$ or less. Each can be pattern coated or flood coated, preferably, however, the contact adhesive adjacent the release coating is substantially contiguous with the substrate. In this case, the substantially continuous release coating is typically flood coated on the second layer.

When brought together as shown in FIG. 2, the adhesive coated surfaces of the first layer 10 and second layer 21 form the cold seal of a package. That is, the interfaced areas of the two layers (or two portions of one substrate) that are respectively coated with the adhesive or adhesives are typically adhesively connected. These surfaces form the inner walls of a cold seal package. Preferably, the space within a cold seal package that does not correspond to the contact area between first and the second contact adhesives is the space available for placement of an article in a cold seal package. Thus, typically only one of the layers of contact adhesive can be coated on substantially the entire surface of one of the substrates with the other being a peripheral coating on the other substrate, for example, although both layers of adhesive can be pattern coated at the periphery of the two substrates. For example, as shown in FIG. 1, the first contact adhesive 14 is coated as a peripheral coating on the first substrate 12, while the second contact adhesive 16 is coated substantially over the entire surface of the second substrate 22. Accordingly, the article to be sealed within a cold seal package resides within the unbonded area 15 outlined by the contact adhesive 14 in FIG. 1.

The substrate or substrates (e.g., first substrate 12 and second substrate 22 of FIG. 2) are each preferably in the form of a sheet material (e.g., a film), although the substrate(s) can be in other forms. For example, a substrate can be molded to form a sheet of connected but individual compartments that, when sealed, can be used as blister packs for individually packaging tablet- or pill-forms of pharmaceuticals and/or nutraceuticals, batteries, and the like. The sheet material can be made of a film, a foil, a woven material, or a nonwoven material.

Materials used to form the sheet material are preferably polymers selected from the group of polyolefins such as polyethylene (including high density, low density, linear low density, metallocene catalyzed polyethylene, etc.) and polypropylene, as well as poly(vinyl acetate), poly(vinylalcohol-co-ethylene), polyvinyl chloride, polyester, poly(ethyl acrylate), ethylene/acrylic acid copolymer (such as that commercially available under the trade designations NUCREL from E.I. du Pont de Nemours, Wilmington, Del., and PRIMACOR from Dow Chemical Co., Midland, Mich.), ethylene/methacrylic acid copolymer, ethylene/vinyl acetate copolymer (such as that commercially available under the trade designation NA 443-021 from Quantum Chemical Co., Cincinnati, Ohio), polychlorotrifluoroethylene, polycarbonate, polytetrafluoroethylene (such as that commercially available under the trade designation of TEFLON from E.I. du Pont de Nemours, Wilmington, Del.), polystyrene, polyacrylonitrile, ionomers of ethylene/methacrylic acid copolymers (such as that commercially available under the trade designation SURLYN from E.I. du Pont de Nemours, Wilmington, Del.), polyamide, poly(vinylidene chloride), paper, and laminates or composites thereof. Metallic foils can also be used, such as aluminum foil or foil laminates, such as those described in U.S. Pat. No. 4,598,826. A particularly preferred material is high density polyethylene (HDPE) because it is typically stable under sterilization conditions, such as gamma radiation, under highly humid conditions, and it is of lower cost than many other suitable materials. When two substrates are used, the two substrates can be of different or of the same materials.

Second layer 21 includes substrate 22 (FIG. 2) with at least one major surface that has been coated with a release coating 19. The release coating 19 (FIG. 2) includes a polymeric material or mixture of materials with release properties. Preferably, the release material is selected from the group of an ethyl acrylate-acrylonitrile copolymer, an acrylic acid-alkyl acrylate copolymer (e.g., acrylic acid-ethyl acrylate copolymer), a polyvinyl chloride resin, a polyvinyl N-octadecyl carbamate, a polyethylene based wax, a polyamide based wax, a polysiloxane, a fluorocarbon polymer, a polyvinyl ester (e.g., vinyl stearate, vinyl palmitate, etc.), a polyethylene imine, an alkyl substituted amine, a fatty acid based wax (e.g., a fatty acid condensate), a chromium complex (e.g., stearato chromic chloride), and mixtures thereof.

Upon applying the release coating composition to a substrate, preferably and advantageously, a substantially continuous release coating is formed. By this it is meant that the release coating includes few, if any, voids, for example. This substantially continuous release coating can be pattern coated or flood coated on the substrate, preferably, however, it is flood coated. The release coating composition can optionally also include a substantially natural latex rubber-free contact adhesive.

The release coating can be coated out of a composition comprising an aqueous dispersion or solution or an organic solvent dispersion or solution. Alternatively, the release coating can be hot melt coated or coated from a 100% solids composition. For ease and environmental concerns, coating the release coating out of water (typically, distilled or deionized water) is preferred. For those release materials available in 100% solids form in pellets, prill, or blocks, conventional hot melt coating techniques can be used to apply a release coating on a substrate.

Significantly, the release coating can include a substantially natural latex rubber-free contact adhesive or mixture of adhesives in addition to the release material. Optional additives to the release coating composition can include ultraviolet light absorbers, antioxidants, viscosity modifiers, and other additives as are known in the art for release compositions. Furthermore, the transfer substrate can optionally include at least one major surface that has been treated to modify the adhesion of the release coating. This can be accomplished using a number of techniques well known to those of skill in the art depending on the substrate chosen, as discussed below for the anchor substrate.

In a preferred cold seal process, the first contact adhesive 14 and the second contact adhesive 16 are adhesives that are nonadhering or slightly adhering to the touch at temperatures of about 15° C. to about 50° C. and require moderate pressure (such as that exerted by fingertip pressure) to achieve a cold seal bond. That is, the contact adhesives are considered non-pressure sensitive in that materials lacking chemical similarity with the adhesive do not have significant adhesion to the adhesive; however, the contact adhesives tenaciously adhere to each other or other materials having chemical similarities. Preferably, they have a glass transition temperature of about 15° C. or less and possess sufficient plasticity to bond to themselves or chemically similar materials under pressure alone and sufficient hardness to resist bonding to dissimilar substrates under pressure.

Contact adhesives coated on one or more substrates in the cold seal process may be the same contact adhesive or they may be different contact adhesives. Preferably, the contact adhesives have an open time of at least about 24 hours at a temperature of about 50° C. or less. The first and second contact adhesives preferably each comprise a material selected from the group of a polychloroprene, a polyurethane (including aqueous polyurethanes as described in U.S. Pat. No. 4,442,259 (Isgur et al.)) a styrene-isoprene copolymers (including terpolymers, tetrapolymers, etc.), a styrene-butadiene copolymer, a polyimide, a polyvinyl chloride, a nitrocellulose, a polyisoprene, an acrylonitrile-butadiene-isoprene terpolymer, a butadiene-methacrylonitrile copolymer (such as those described in U.S. Pat. No. 5,145,929 (Ou-Yang)); a polyethylene-vinyl acetate copolymer, a polyacrylate, and mixtures thereof. Preferably, at least one of the first and second contact adhesives is formed from an aqueous polyurethane dispersion. A particularly preferred contact adhesive is formed from an aqueous polyurethane dispersion.

The contact adhesive can be coated out of a composition comprising an aqueous dispersion or solution or an organic solvent dispersion or solution. Alternatively, the contact adhesive can be hot melt coated or coated from a 100% solids composition. For ease and environmental concerns, coating the adhesive out of water (typically, distilled or deionized water) is preferred, although it is to be understood that some desirable adhesives can only be coated out of an organic solvent, such as heptane, toluene, isopropyl alcohol, methyl ethyl ketone, and the like. Additionally, for those adhesives available in 100% solids form in pellets, prill, or blocks, conventional hot melt coating techniques can be used to apply a coating of contact adhesive on a substrate.

Referring again to FIG. 2, a partially assembled package web 20 is shown. Pressure is applied to the first layer 10 coated with a contact adhesive 14 and the second layer 21 coated with a release coating 19 and contact adhesive 16, such that the contact adhesives 14 and 16 contact one another. Preferably, and advantageously, pressure can be applied at room temperature, and even at temperatures within a range of about 15° C. to about 50° C., which simplifies the sealing process because highly heated crimping tools are not required. Once sealed, the contact adhesives 14 and 16 form a substantially continuous adhesive portion between the first layer 10 and the second layer 21.

In FIG. 2, a traverse cut 24 is further provided though both first layer 10 and second layer 21 that crosses the cut line created by perforation cut 18 in first layer 10 at least once. In the preferred embodiment shown in FIG. 2, the traverse cut 24 crosses perforation cut 18 twice. The traverse cut 24 and perforation cut 18 define a bonded section 30. A separation cut 28 is also provided to separate package web 20 into individual packages 32 (shown in FIG. 4). The traverse cut 24 crosses perforation cut 18 such that an unbonded portion 36 is defined adjacent perforation cut 18 on the surface of first layer 10 opposite bonded section 30.

Figure 4:
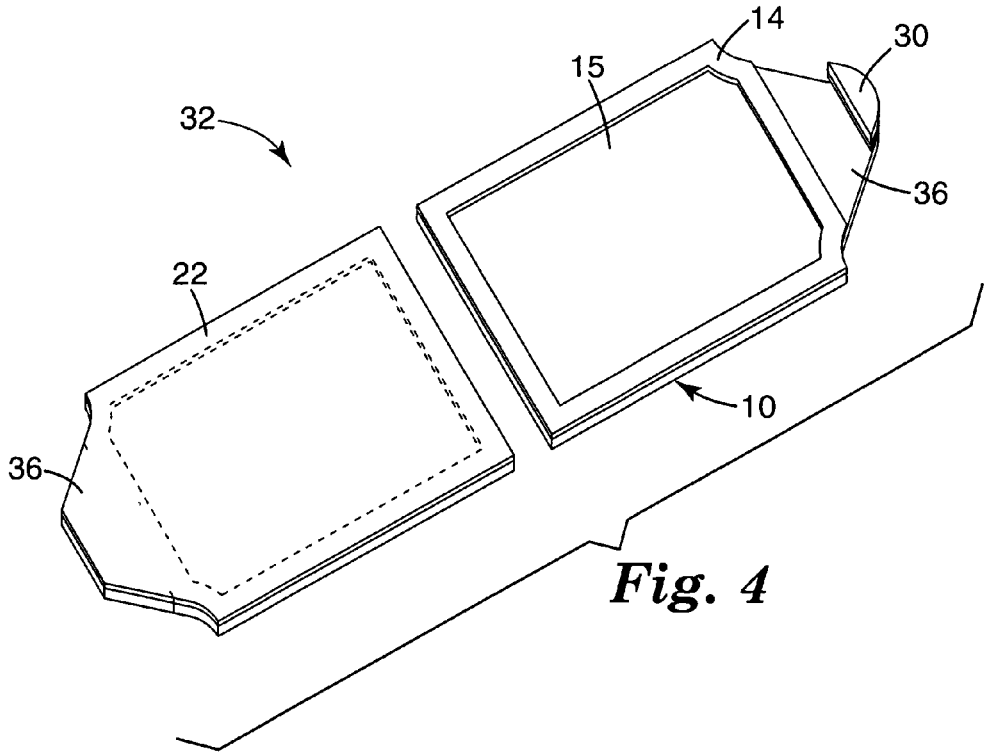
FIG. 4 is an exploded view of an opened package in accordance with the invention.

In FIG. 4, an opened package 32 of the package web 20 in FIG. 2 is shown. The unbonded portion 36 is located between the pattern of contact adhesive 14 and the perforation cut 18 (shown in FIG. 2). Unbonded portion 36 provides the user a means to grasp both the first layer and second layer to separate the layers and open package 32. To facilitate the user's grasp, the unbonded portion 36 is preferably at least 3 mm, and more preferably 6 mm, in width from the edge of the pattern of contact adhesive 14 to perforation cut 18. Once separated, a portion of the first layer 10 and second layer 21 remain bonded together in the tab formed by bonded section 30.

In the opened package 32 shown in FIG. 4, adhesion between the contact adhesive and the first layer is greater than adhesion between the contact adhesive and the release-coated second layer. Preferably, substantially all of the contact adhesive remains on the first major surface of the first layer upon opening the cold seal package by peeling the first layer and second layer apart. More preferably, at least a portion of the substantially continuous release coating also remains on the contact adhesive upon opening a cold seal package by peeling the first layer and second layer apart. Preferably, a cold seal package has a T-Peel Force between the release-coated second layer and the contact adhesive of about 600 g/2.5 cm or less.

Figure 5:
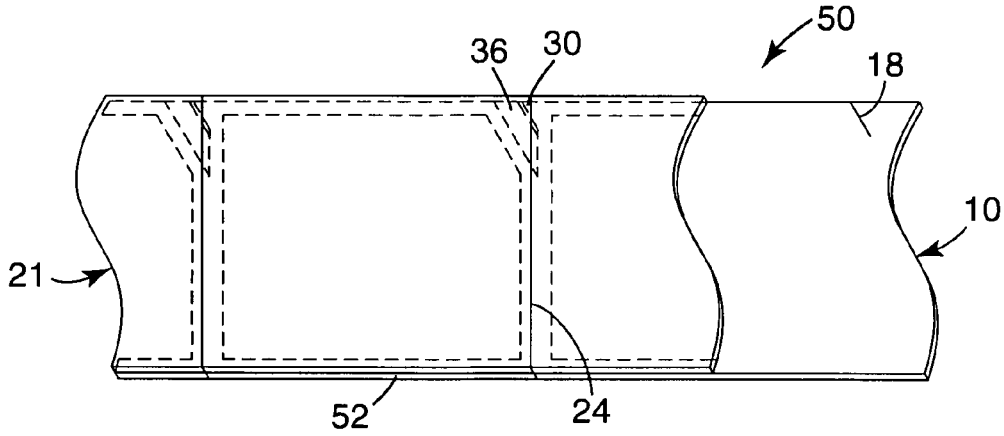
FIG. 5 is a perspective view of a package web in another illustrative embodiment in accordance with the invention.

FIG. 5 shows an alternate embodiment of a package web 50. Package web 50 includes a first layer 10, second layer 21, and perforation cut 18. In the embodiment shown in FIG. 5, the traverse cut 24 also functions as the separation cut to separate the package web 50 into individual packages 52. The traverse cut 24 also must cross the perforation cut 18 only once to form the bonded section 30. Rather than the nested package web orientation shown in FIG. 2, the individual packages 52 are manufactured sequentially on package web 52.

The unbonded portion 36 is located between the pattern of the bonded area and the perforation cut 18 (shown in FIG. 5). Unbonded portion 36 provides the user a means to grasp both the first layer and second layer to separate the layers and open package 52. To facilitate the user's grasp, the unbonded portion 36 is preferably at least 3 mm, and more preferably 6 mm, in width from the edge of the pattern of the bonded area to perforation cut 18. Once separated, a portion of the first layer 10 and second layer 21 remain bonded together in the tab formed by bonded section 30.

Figure 6:
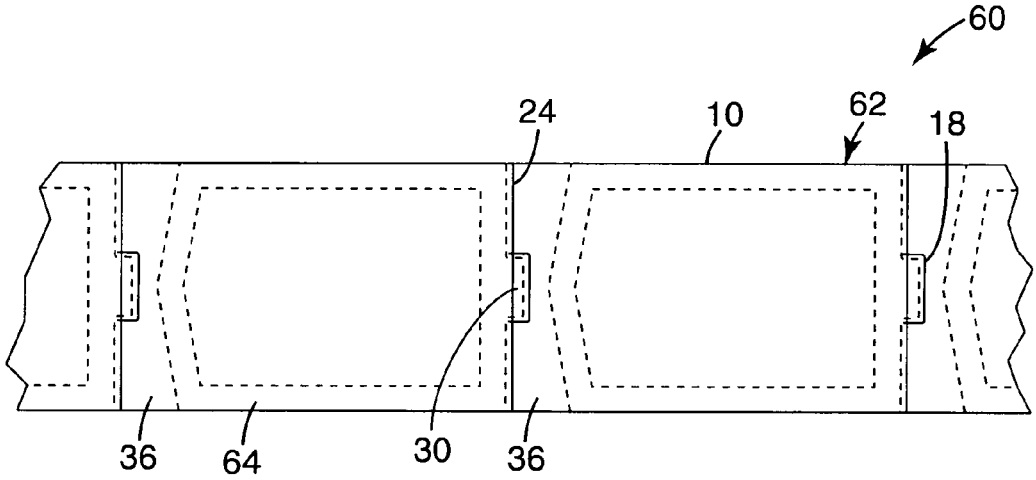
FIG. 6 is a plan view of a package web in another illustrative embodiment in accordance with the invention

FIG. 6 is an alternate embodiment of a heat-sealed package web 60. Instead of a perforation cut in the down web direction as shown in FIGS. 1-3, a three-sided perforation cut 18 in both the down web and cross web direction in first layer 10. A heat seal pattern 64 is formed between first layer 10 and second layer 21 (not shown). Bonded section 30 is then formed by traverse cut 24 in both layers 10 and 21 in the cross web direction of package web 60. In the embodiment shown in FIG. 6, the traverse cut 24 also functions as the separation cut to separate the package web 60 into individual packages 62.

Figure 7:
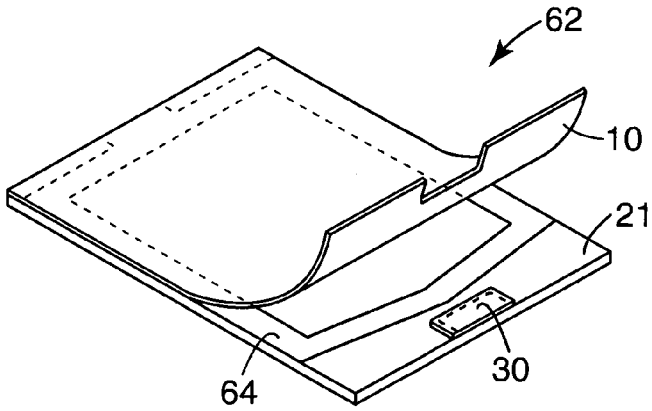
FIG. 7 is a perspective view of an individual package of the package web of FIG. 6 in accordance with the invention.

Again in the embodiment of FIGS. 6 and 7, the unbonded portion 36 is located between the pattern of the bonded area and the perforation cut 18. Unbonded portion 36 provides the user a means to grasp both the first layer and second layer to separate the layers and open package 62. To facilitate the user's grasp, the unbonded portion 36 is preferably at least 3 mm, and more preferably 6 mm, in width from the edge of the pattern of the bonded area to perforation cut 18. Once separated, a portion of the first layer 10 and second layer 21 remain bonded together in the tab formed by bonded section 30. The bonded area 30 can remain with the individual packages 62 when separated by traverse cut 24 as shown in FIG. 7.

Printing or graphic indicia can be applied to the first layer, the second layer, or both in the manufacturing methods of the present invention. Graphic indicia (e.g., text and corporate identifications) can be printed using processes conventionally used in the graphic arts industry.

When used, the release coating and adhesive coating layers can be coated onto either substrate by conventional coating techniques, such as flood coating, pattern coating, air knife coating, reverse roller coating, flexographic or gravure coating, etc., with pattern coating being preferred. Alternatively, any of the substrates and coatings may be made by extruding, including coextruding techniques.

Typically, in forming a package, the step of contacting the adhesive coatings to form a seal produces an enclosure within the package. An article, preferably, a medical product such as a bandage, for example, is placed in the enclosure before completely sealing the package. Typically, when a medical product is placed inside the package, after sealing the package, the method includes a step of sterilizing the medical product. The method of the invention can also optionally include a step of printing graphic indicia on a substrate, such as on one of the separate sheet materials.

Packages of this invention can be used for medical devices or for any conventional uses of packages. They can also be employed in modified atmosphere packaging wherein the product to be contained within the package and/or the package are prepared under a sterile and/or inert atmosphere, and the product is packaged within the package under the same or similar conditions.

All patents, patent documents, and publications cited herein are incorporated by reference as if each were individually incorporated by reference. Various modifications and alterations of this invention will be apparent to those skilled in the art without departing from the scope and spirit of this invention, and it should be understood that this invention is not limited to the illustrative embodiments set forth herein.

What is claimed is:

1. A method of manufacturing a package, comprising providing a first layer with perforation cuts through the first layer;

providing a second layer;

attaching the first layer to the second layer by a sealing process to create a bonded area comprising a peelable seal;

providing a traverse cut through both the first and second layer that traverses the perforation cut in the first layer at least once to form at least two bonded sections in the first layer, wherein each of the bonded sections comprise attached portions of the first layer and second layer;

wherein at least one bonded section created by the sealing process forms a tab defined by the perforation cut and traverse cut wherein the tab is retained by the second layer; and wherein at least a portion of the first and second layer adjacent the perforation cut is unbonded.

2. The method of claim 1, further comprising providing a separation cut through the first and second layer that forms multiple individual packages, wherein each package contains at least one perforation cut.

3. The method of claim 1, wherein the traverse is a sinusoidal cut.

4. The method of claim 1, wherein the traverse cut through the first and second layer forms multiple packages, wherein each package contains at least one perforation cut.

5. The method of claim 1, wherein the perforation cut does not cross any bonded section of the bonded area.

6. The method of claim 1, wherein the first layer and/or the second layer is selected from the group consisting of metallic foils; polyolefins such as polyethylene and polypropylene; poly(vinyl acetate); poly(vinylalcohol-co-ethylene); polyvinyl chloride; polyester; poly(ethyl acrylate); ethylene/acrylic acid copolymer; ethylene/methacrylic acid copolymer; ethylene/vinyl acetate copolymer; polychlorotrifluoro ethylene; polycarbonate; polytetrafluoro ethylene; polystyrene; polyacrylonitrile; ionomers of ethylene/methacrylic acid copolymers; polyamide; poly(vinylidene chloride); paper; and laminates or composites thereof; and combinations thereof.

7. The method of claim 1, wherein the first layer and/or the second layer is high density polyethylene.

8. The method of claim 1, further comprising a step of printing graphic indicia on at least one of the layers.

9. The method of claim 1, wherein the peelable seal is a cold seal.

10. The method of claim 1, wherein the sealing process is a cold seal process.

11. The method of claim 1, further comprising steps of placing a medical product between the layers before sealing the package and sterilizing the medical product after sealing the package.

* * * * *